United States Patent [19]

Martin

[11] 4,159,352

[45] Jun. 26, 1979

[54] RESISTANCE OF SURFACES TO METAL MARKING

[75] Inventor: Kenneth E. Martin, Lower Burrell, Pa.

[73] Assignee: Aluminum Company of America, Pittsburgh, Pa.

[21] Appl. No.: 840,642

[22] Filed: Oct. 11, 1977

[51] Int. Cl.[2] ..... B05D 1/12

[52] U.S. Cl. ..... 427/11; 427/180

[58] Field of Search ..... 427/11, 180, 445, DIG. 1

[56] References Cited

U.S. PATENT DOCUMENTS

| | | | |
|---|---|---|---|
| 2,673,818 | 3/1954 | Woog | 427/11 |
| 2,817,603 | 12/1957 | Louis | 427/180 X |
| 3,025,184 | 3/1962 | Blair | 427/11 |
| 3,041,140 | 6/1962 | Alexander | 427/11 X |
| 3,075,279 | 1/1963 | Haltner et al. | 427/11 X |
| 3,274,019 | 9/1966 | La Vine | 427/180 X |
| 3,300,333 | 1/1967 | Page | 427/11 |
| 3,359,128 | 12/1967 | Humphrey et al. | 427/180 X |
| 3,573,962 | 4/1971 | Blampin | 427/11 |

FOREIGN PATENT DOCUMENTS

| | | | |
|---|---|---|---|
| 733065 | 4/1966 | Canada | 427/180 |

*Primary Examiner*—Shrive P. Beck
*Attorney, Agent, or Firm*—Andrew Alexander

[57] ABSTRACT

A method of increasing the resistance of colored surfaces, including white, light and pastel colors, to metal marking comprises treating the surface with a finely divided, powdered material to provide an extremely thin layer of the powdered material on the surface, the treating being for a period of time sufficient to increase the resistance of the surface to metal marking.

4 Claims, No Drawings

RESISTANCE OF SURFACES TO METAL MARKING

INTRODUCTION

This invention relates to colored surfaces and, more particularly, it relates to improving the resistance of colored surfaces to metal marking.

Because of new ecological standards which have been set, and because of increased emphasis on energy conservation in the paint industry, considerable work has been done to permit use of waterborne paints for applications where solvent borne paints were normally used. This substitution or conversion has not been without problems. For example, where waterborne paints are used on metal substrates, e.g. aluminum siding, it has been found that the painted and cured surface can be susceptible to metal marking. That is, waterborne paint coatings, particularly light or pastel colors, including whites and grays, can be easily marked when the surface of the coating comes in contact with unpainted edges of the metal. Such contact can come about, for instance in the case of painted aluminum siding, when the siding is removed from packages or cartons thereof, at the work site. It should be understood that such metal marking does not interfere with the integrity of the coating, but rather is of concern principally from an aesthetic standpoint.

Another problem that can arise with the use of waterborne paint coatings is staining or soiling of the coating by dirt or dust collection. The dirt collection evidently arises from air-borne dust, etc., which, for some reason not clearly understood, because of the nature of the coating is not easily removed by water washing.

Attempts have been made at resolving these problems, particularly in the waterborne systems, by the inclusion of pigment dispersants, surfactants, lubricants, waxes and resinous modifiers in the paint. However, to date these attempts are not known to have resulted in a commercially feasible solution. Thus, it can be seen that there is a great need for a system that solves these problems.

The present invention provides a very economical treatment which, when applied to a colored surface, such as a painted surface, greatly increases the resistance of the surface to metal marking and to dirt collection.

SUMMARY OF THE INVENTION

An object of the present invention is to improve the resistance of colored surfaces to metal marking.

Another object of the present invention is to improve the resistance of painted surfaces to metal marking.

Yet a further object of the present invention is to improve the metal marking resistance of surfaces coated with waterborne paints.

These and other objects will become apparent from the specification and claims appended hereto.

In accordance with these objects, the present invention improves the resistance of colored surfaces to metal marking by treating or applying a finely divided powdered material to the colored surface to provide an extremely thin layer of the powdered material thereon. In a preferred embodiment, the finely divided material comprises talc powder.

DETAILED DESCRIPTION OF THE PREFERRED EMBODIMENTS

In accordance with the present invention, the metal marking resistance of colored surfaces, such as painted surfaces, particularly surfaces which have been coated or painted utilizing a waterborne paint, can be improved by applying a finely divided powdered material to the surface by dry rubbing to provide a very thin layer of the powdered material on the surface.

The process of the present invention is paticularly applicable to pastel or pale colors. That is, pale colors, including white, such as light blues, yellows, greens, beiges, tans, etc., can be particularly susceptible to metal marking, as well as other types of marking or soiling which can result from dirt collection. Also, if the painted surface were to develop mildew resulting from the dirt collection, for example, this could be particularly noticeable on the paler colors. It should be understood that by reference to colored surfaces herein, it is intended to include whites and grays, as well as the light or pastel colors referred to above.

It should be understood that the treatment of the present invention can have application to surfaces other than painted surfaces. For example, the invention would have application to colored plastic surfaces, such as would be found on articles, e.g. panel siding for buildings, formed from polyvinylchloride. Such plastic panel siding can be subject to metal marking from various tools used during construction or application of the siding to the building.

An important aspect of the present invention resides in the fact that the color of the surface, particularly pastel or pale colors, treated in accordance with the invention, does not noticeably change. Thus, it can be seen that the treatment is highly advantageous since it operates to increase the resistance of a coating or surface to metal marking, yet the treatment does not noticeably affect the color of the surface.

While it has been noted that the treatment in accordance with the invention has application to colored surfaces and coating or metals such as aluminum and steel, it is particularly beneficial when applied to surfaces painted or coated with waterborne paints. By waterborne paints is meant paints employing water as the solvent or dispersion medium. Exemplary of such paints are the acrylic emulsion types available from suppliers such as PPG Industries, Inc., DeSoto, Inc. or Glidden-Durkee Division of SCM Corp. under the respective names Environ, Hydroform or Aqualure. It should be noted that the invention also has application to other resin systems such as fluorocarbons, vinyls, alkyds, acrylics, polyesters and epoxy.

In accordance with the principles of the invention, the resistance of colored surfaces to metal marking is increased by applying or depositing a finely divided, powdered material on the surface by dry rubbing to provide a very thin, adherent layer of the powdered material on the surface. The treatment is controlled so as to provide or deposit up to 750 mg/m$^2$ with a preferred amount being in the range of 100 to 425 mg/m$^2$ of the powdered material on the treated surface, with a typical application applying about 300 mg/m$^2$. That is, these amounts would remain adhered to the surface after nonadherent powder is removed as by use of an air knife, for example. Also, preferably, the powdered material has a particle size of not more than 325 mesh (Tyler Series). A highly suitable mean particle size is in the range of 0.5 to 9.0 μm.

Preferably, the powdered material comprises at least one material selected from the group consisting of metal silicate and metal oxide. Also, it has been found that silica may be employed as the powdered material. Other materials that can be used in accordance with the invention include corn starch, flour, sodium bicarbonate and calcium carbonate but on a much less preferred basis. Preferably, the silicate is at least one selected from the group consisting of magnesium silicate and aluminum silicate. One form of magnesium silicate which has been found to be highly suitable is talc which may be referred to as $3MgO.4SiO_2.H_2O$ or $Mg_3SiO_{10}(OH)_2$ and is described more fully in Kirk-Othmer *Encyclopedia of Chemical Technology*, Vol. 19, pages 608–613, incorporated herein by reference. Talc-like substances, such as soapstone and pyrophyllite may be used in the present invention. In addition, impurities such as minerals commonly associated with talc may be present without adversely affecting the performance of talc in the present invention.

While it is not clearly understood why application of powdered material, e.g. talc, operates to improve the resistance of colored surfaces to metal marking and also while the inventor does not necessarily wish to be held to any theory of invention, it is believed that the metal marking results from hard pigment particles at the surface coming in contact with the bare or uncoated parts of metal objects. It is believed that the powdered material is mechanically bonded to the colored surface as a result of rubbing action and somehow acts to prevent the hard pigment from coming in contact with a metal object which would otherwise mark the colored surface.

In another aspect of the present invention, materials can be incorporated in the finely divided powdered materials and applied simultaneously with the treatment to improve the resistance of the surface to metal marking. That is, if it is desirable to enhance the resistance of the coated or painted surface to mildew, suitable inhibitors can be added to the powdered material and may be applied during the treatment without adversely affecting the improved resistance to metal marking.

In order to exemplify the process of the present invention as it applies to siding, e.g. aluminum siding used for building products, aluminum sheet is first subjected to a cleaning treatment with an alkaline type cleaner. A conversion coating is then applied to the sheet which is followed by a coating of an epoxy or acrylic-based primer such as Environ available from PPG. The primer coat is baked at a peak metal temperature in the range of 90 to 230° C. A final coating of a waterborne acrylic, such as Environ available from PPG, is applied, cured and quenched. If these treatments are provided on the sheet on a continuous basis, after the curing and quenching steps, the sheet may be treated in accordance with the present invention to improve the metal marking resistance of the coating. Or the sheet may be coiled and treated in accordance with the invention during a subsequent operation, such as, for example, slitting of the sheet. After treating in accordance with the present invention, the sheet may be formed or shaped as is conventional in providing siding for building application.

The following examples are still further illustrative of the invention.

EXAMPLE 1

Specimens having painted surfaces were treated by dry rubbing talc powder to provide an extremely thin layer of talc on the surface. Excess or nonadherent powder was removed with air. In Table 1, the change in color, E, (Hunter color difference units) is calculated according to ASTM Designation D2244-68.

TABLE 1

EFFECT OF TREATMENT IN ACCORDANCE WITH THE INVENTION ON LIGHT COLORED SURFACES

| Specimen Number | Coating Description | Color Difference* | | | | Gloss - % | | | |
|---|---|---|---|---|---|---|---|---|---|
| | | | | | | 60° | | 85° | |
| | | ΔL | Δa | Δb | E | Untreated | Treated | Untreated | Treated |
| 464195 | White (1) | 0.36 | −0.33 | 0.19 | 0.52 | 13.5 | 8.8 | 18.1 | 13.8 |
| 464196 | White (2) | −0.46 | 0.39 | 0.03 | 0.60 | 6.4 | 6.5 | 18.8 | 14.6 |
| 464200 | Nu Green (2) | 1.27 | 0.49 | −0.56 | 1.46 | 7.0 | 6.0 | 15.0 | 11.9 |
| 464203 | Sandtone (2) | 0.47 | 0.01 | −0.94 | 1.05 | 6.7 | 5.7 | 17.4 | 11.7 |
| 464204 | Sierra (2) Tan | 1.19 | 0.33 | −1.60 | 2.02 | 9.3 | 6.1 | 17.0 | 10.5 |
| 464217 | RCE (1) White | 0.48 | 0.07 | 0.03 | 0.49 | 83.3 | 44.5 | 94.7 | 74.4 |

*Color Difference — Treated panel minus untreated panel in Hunter color difference units.
(1) Duracron Paint — PPG solvent borne paint
(2) Environ Paint — PPG waterborne paint
E indicates change in color between untreated and treated specimens.

It will be seen from the above example that pastel or pale colors are not adversely affected by the treatment in accordance with the present invention. Furthermore, the treated specimens exhibited a high degree of resistance to metal marking when compared to the untreated specimens.

EXAMPLE 2

The specimens tabulated below were coated with white Environ and yellow Hydroform waterborne acrylic paint and then dry rubbed with different powdered materials to increase the resistance of the painted surface to metal marking. Included in the tabulation, for comparison purposes, are powders which do not improve or only slightly improve the resistance of the coated surface to metal marking. In the tabulation, the degree of metal marking is measured by a nickel stylus mounted on Taber Scratch Hardness Tester and the degree or amount of metal marking measured with weights of 100, 500 and 1000 grams load. The intensity of the mark produced was rated between 0 and 10 with a number of 10 indicating no visible marking obtained at 100, 500 or 1000 grams weight. A number less than that of the untreated surface indicates a decrease in resistance to metal marking. A number the same as the untreated surface indicates no change in the resistance to metal marking.

TABLE 2

| Name | Type | Source | Color | Effective Load 100 grams Treated | 100 grams Untreated | 500 grams Treated | 500 grams Untreated | 1000 grams Treated | 1000 grams Untreated |
|---|---|---|---|---|---|---|---|---|---|
| Hydrite R | Aluminum Silicate | Georgia Kaoline Co. | Yellow | 10 | 7 | 10 | 5 | 10 | 2 |
| " | " | " | White | 10 | 7 | 9 | 5 | 9 | 2 |
| MP 10-52 | Talc | Pfizer Minerals, Pigments & Metals Div. | Yellow | 10 | 7 | 9 | 5 | 8 | 2 |
| " | " | " | White | 9 | 7 | 8 | 5 | 6 | 2 |
| MP 45-26 | " | " | Yellow | 9 | 7 | 6 | 5 | 5 | 2 |
| " | " | " | White | 8 | 7 | 5 | 5 | 5 | 2 |
| Hydrate Flat D #2460 | Clay | Georgia Kaoline Co. | Yellow | — | — | 9 | 5 | 8 | 2 |
| " | " | " | White | 9 | 7 | 6 | 5 | 5 | 2 |
| Cab-O-Sil M5 | Silica | Cabot Corp. | Yellow | 8 | 7 | 6 | 5 | 3 | 2 |
| " | " | " | White | 8 | 7 | 5 | 5 | 3 | 2 |
| Cab-O-Sil M7 | " | " | Yellow | 8 | 7 | 6 | 5 | 4 | 2 |
| " | " | " | White | 8 | 7 | 5 | 5 | 3 | 2 |
| Micro Check 12 | Mildewcide | Ferro Chemical Corp. | Yellow | 8 | 7 | 5 | 5 | 4 | 2 |
| " | " | " | White | 8 | 7 | 5 | 5 | 3 | 2 |
| #618 Talc | Talc | Whitaker, Clark & Daniels, Inc. | Yellow | 9 | 7 | 6 | 5 | 4 | 2 |
| " | " | " | White | 9 | 7 | 6 | 5 | 4 | 2 |
| Calcium Stearate | Calcium Stearate | Fisher Scientific | Yellow | 8 | 7 | 5 | 5 | 4 | 2 |
| " | " | " | White | 7 | 7 | 5 | 5 | 4 | 2 |
| Kaopoque 30 | Aluminum Silicate | Georgia Kaolin Co. | Yellow | 8 | 7 | 6 | 5 | 3 | 2 |
| " | " | " | White | 7 | 7 | 5 | 5 | 2 | 2 |
| Zinc Stearate | Zinc Stearate | Fisher Scientific | Yellow | 7 | 7 | 5 | 5 | 2 | 2 |
| " | " | " | White | 7 | 7 | 5 | 5 | 2 | 2 |
| DuPont R100 | $TiO_2$ | E.I. DuPont de Nemours & Co., Inc. | Yellow | 6 | 7 | 3 | 5 | 0 | 2 |
| " | " | " | White | 6 | 7 | 3 | 5 | 0 | 2 |

From the above table it will be seen that Hydrite R, an aluminum silicate type compound, improved the resistance of the yellow colored specimen to metal marking five-fold and the white colored specimen not quite as much at the 1000 gm test. Also, it will be noted that the use of talc compounds such as MP 10-52 and MP 45-26 increased the resistance of the treated surface substantially. In addition, it will be observed that treatment with some compounds such as zinc stearate did not affect the resistance to metal marking. Furthermore, a treatment with a $TiO_2$ powder, in fact, decreased the resistance of the coated surface to metal marking.

It should be noted that application of powdered material, e.g. talc powder, in accordance with the invention, in addition to improving the mark resistance due to metal also improves mark resistance due to dirt collection resulting from airborne dust, for example. That is, it has been found that surfaces coated with waterborne paint, for example, and treated in accordance with the invention, exhibited a much greater resistance to accumulation of airborne particles such as dust than untreated material.

While the invention has been described in terms of preferred embodiments, the claims appended hereto are intended to encompass other embodiments which fall within the spirit of the invention.

Having thus described the invention and certain embodiments thereof, what is claimed is:

1. A method of increasing the resistance of a paint coating on a sheet metal substrate to metal marking, the method comprising:

treating said paint coating with a finely divided powdered material by dry rubbing to provide an extremely thin, adherent layer of said powdered material on the surface, the powdered material being at least one material from the group consisting of metal silicate and metal oxide, said treating being employed for a period of time sufficient to increase the resistance of the paint coating to metal marking.

2. The method according to claim 1 wherein the powdered material employed is selected from the group consisting of magnesium and aluminum silicate.

3. The method according to claim 1 wherein the powdered material comprises talc.

4. A method of increasing the resistance of a waterborne coating to marking, comprising:

dry rubbing said coating surface with talc powder having a mean particle size in the range of 0.5 to 9.0 microns to provide an adherent layer thereon ranging from 100 to 425 $mg/m^2$, the rubbing action being employed for a period of time sufficient to increase the resistance of the coating to metal marking.

* * * * *